US007225750B2

(12) United States Patent
Menard

(10) Patent No.: US 7,225,750 B2
(45) Date of Patent: Jun. 5, 2007

(54) RESCUE SHIP FOR DISABLED VESSELS, VESSELS RESCUE METHOD, AND USE OF A RESCUE SHIP

(76) Inventor: Serge Menard, Sente Baudoin, Puys, Neuville-les-Dieppe (FR) F-76370

( * ) Notice: Subject to any disclaimer, the term of this patent is extended or adjusted under 35 U.S.C. 154(b) by 0 days.

(21) Appl. No.: 10/541,358

(22) PCT Filed: Jan. 8, 2004

(86) PCT No.: PCT/FR2004/000025

§ 371 (c)(1),
(2), (4) Date: Jul. 6, 2005

(87) PCT Pub. No.: WO2004/069646

PCT Pub. Date: Aug. 19, 2004

(65) Prior Publication Data

US 2006/0086304 A1 Apr. 27, 2006

(30) Foreign Application Priority Data

Jan. 8, 2003 (FR) ..... 03 00141

(51) Int. Cl.
*B63B 35/40* (2006.01)
*B63B 35/44* (2006.01)

(52) U.S. Cl. ..... 114/259; 114/263

(58) Field of Classification Search ..... 114/259, 114/260, 45, 50
See application file for complete search history.

(56) References Cited

U.S. PATENT DOCUMENTS

| | | | | |
|---|---|---|---|---|
| 3,133,518 | A | 5/1964 | Burnett | |
| 3,823,681 | A * | 7/1974 | Cushing et al. | 114/260 |
| 3,934,530 | A * | 1/1976 | Kossa et al. | 114/260 |
| 5,215,024 | A | 6/1993 | McAllister | |
| 5,347,944 | A | 9/1994 | Dupre et al. | |
| 5,988,093 | A | 11/1999 | Ni | |

FOREIGN PATENT DOCUMENTS

| | | |
|---|---|---|
| AU | 482 040 | 3/1977 |
| BE | 730 402 | 9/1969 |
| FR | 2 589 123 | 4/1987 |
| GB | 1 204 656 | 9/1970 |
| GB | 1 450 575 | 9/1976 |
| GB | 2 144 680 | 3/1985 |

* cited by examiner

*Primary Examiner*—Jesús D. Sotelo
(74) *Attorney, Agent, or Firm*—Young & Thompson

(57) ABSTRACT

A rescue ship for a disabled vessel includes a hull which delimits an elongated dock (12) which is at least 150 m long and preferably at least 250 m long and at least 30 m wide and preferably at least 45 m wide, and including a ballasting device enabling draught modification by at least 15 m and preferably at least 20 m. The hull has two lateral hulls capable of being ballasted (14) and enclosing the dock (12), and the stem has a practically sealed door (18) which can close the rear of the dock (12). The ship further includes maneuvering elements designed to exert a thrust in one direction transverse at least to the longitudinal axis of the ship. The invention is applicable to the rescue of disabled vessels.

5 Claims, 3 Drawing Sheets

RESCUE SHIP FOR DISABLED VESSELS, VESSELS RESCUE METHOD, AND USE OF A RESCUE SHIP

This invention relates to a rescue vessel for vessels in distress, its operating process, and applications of such a vessel.

Damage of any type that occurs in tankers that transport toxic materials creates pollution incidents called "oil slicks" in the case of hydrocarbons. The consequences of these pollution incidents are considerable. It is possible to cite in particular the possible loss of the tanker by foundering (value of the vessel), the loss of a portion or all of the cargo, and primarily the considerable economic losses for the coastal populations concerned (destruction of sites, destruction of fish farms, destruction of wild animals, losses due to fishing, etc.).

These oil slicks are therefore the source of ecological problems that have consequences on the political level.

It is further necessary to note that not only these pollution incidents can be caused by accidents of tankers that are in poor condition or are old, but also that the same problems arise when the crew is incompetent, and in the case of much more recent tankers in good condition that were built with high-resistance steels that allowed a reduction in thickness, a gain in weight and an increase of the tonnage. The tankers that are formed by these steels become worn out very quickly, however, and they pose the same problem as tankers that are dilapidated and in poor condition.

To eliminate these problems, a first conceivable solution is the towing of the vessel to a location where it will do less damage in case it founders. Experience has shown, however, that the situations that produce these pollution incidents generally occurred in very bad weather and that it was virtually impossible to do this kind of towing during the first few days when the vessel is still afloat.

It was therefore conceivable to use pollution-cleanup vessels. These vessels are designed to vacuum up the hydrocarbons that are released by vessels in distress, in general after they have sunk. The largest pollution-cleanup vessels considered are able to remove only several thousand tons of crude, and a large number of rotations between the site of the disaster and a port that can accept the recovered materials are therefore necessary in the case of a major oil slick. A considerable amount of time is therefore necessary and during the latter, the effects of the oil slick can continue. These pollution-cleanup vessels are therefore only a very partial solution. In addition, the latter can work only in relatively calm weather and not during storms.

These pollution-cleanup vessels do not prevent the vessel in distress from sinking and from becoming at that time a sort of "delayed-action bomb" that can create pollution incidents for long periods, independently of the significant ecological risk constituted by such a vessel at the bottom of the sea.

If the causes of these pollution incidents or oil slicks are studied, it is noted that they are in general the fact of tankers that are subject to damage (breaking of the hull, leaks, malfunctions) because of their great age, or tankers that undergo maritime disasters (damages due to storms, collisions or malfunctions) because of a crew's incompetence.

Aside from several rare cases where, following a collision, a vessel sinks very quickly, a very large majority of pollution incidents or oil slicks were caused by a vessel that continue to float for several days. In addition, a very large majority of the fleet of tankers have a total length of less than 250 m and even 200 m.

The object of the invention is to eliminate the very large majority of pollution incidents or oil slicks by very quickly rendering safe vessels in distress that may be the cause of significant pollution incidents or oil slicks or similar dangers, such as chemical and biological risks.

The invention therefore has as its object the recovery both of the vessel and its cargo by its safeguarding in a way that then allows either the repair or the recovery of the cargo, or these two operations.

For this purpose, the main object of the invention is the supplying of a rescue vessel that has a basin of very large dimensions that can quickly get up close to the vessel in distress and can place this vessel in distress into its basin whose dimensions are obviously quite larger than those of the vessel in distress.

According to document U.S. Pat. No. 5,215,024, a floating artificial island that is equipped with basins that can be closed so that vessels can be protected against heavy weather during their loading and unloading maneuvers is already known. The artificial island does not have autonomous means of propulsion and cannot be ballasted, whereby its function is to be as stationary as possible to perform its function. It is not able to quickly get up close to a vessel in distress and to place this vessel in distress in its basin.

According to document GB-2 144 680, a type of box that forms a floating dock and that is designed to ensure, by ballasting and deballasting, surrounding a lateral hull of a floating platform to allow the repair of this hull is also known. The box has dimensions that are only slightly larger than those of the lateral hull, and it does not have autonomous propulsion means or even a form of vessel, because it is not intended to sail. It therefore does not constitute a rescue vessel that has a basin of very large dimensions that can quickly get up close to a vessel in distress and can place this vessel in distress within its basin.

According to document U.S. Pat. No. 5,988,093, a floating dock that constitutes a U-shaped structure that is intended to move along a vessel, on the sides and under the bottom of the latter, for cleaning the surface thereof, is also known. This dock is open on two ends, and it does not form a basin of very large dimensions.

According to document AU-482 040, a barge transport vessel whose elongated hull delimits a space that is intended to contain barges that are very close to one another and the sides of the vessel is also known. The internal space that is delimited by the hull does not constitute a basin because it is entirely open to the rear.

To reach its main object, which cannot be reached by any of the devices of the above-mentioned documents, the invention relates to a rescue vessel for vessels whose hull delimits an elongated basin of at least 150 m in length and 30 m in width and that comprises a ballast device that makes it possible to alter the vessel's draft by at least 15 m.

The basin preferably has a length of at least 250 m and a width of at least 45 m, and the draft alteration can reach at least 20 m.

In a first embodiment, the hull comprises two lateral hulls that can be ballasted and that surround the basin, and the stem has a virtually sealed door that can close the rear of the basin.

In a variant, the door that can close the rear of the basin comprises two flaps that each comprise two parts that are articulated together around a vertical axis that is intended to work with the vertical axis of the other flap when the door is closed. At least one of the ends of the two articulated parts that are distant from the vertical axis is preferably attached to the corresponding vertical side of the rear hull by a slide that can move horizontally along the internal side of the rear part of the hull.

In another variant, the door that is intended to close the rear of the basin comprises a detachable panel that can be ballasted to move from a floor position that is close to the bottom of the basin to an approximately vertical position of a door for closing the rear of the basin.

In a first embodiment, it is advantageous that the vessel comprises at least one winch for towing a vessel in distress that is entering the basin by the stem.

In another embodiment, at least one side of the basin has a height that is less by at least 15 m than that of at least two other sides. In an embodiment, the two longitudinal sides, port and starboard, both preferably have a height that is less by at least 20 m than that of the other two sides delimited to the front and to the rear of the vessel, and their upper edge is virtually rectilinear over the largest portion of its length. This edge is preferably provided with a reinforcement, advantageously having elasticity properties.

In all the embodiments, the rescue vessel preferably comprises maneuvering means that are intended to exert a thrust in a direction that is transverse to at least the longitudinal axis of the vessel.

The rescue vessel preferably comprises guiding and holding devices of a vessel inside the basin, such as hydraulic thrusters that are incorporated in the basin.

The rescue vessel preferably comprises stabilizers that stabilize it in the presence of swells.

The rescue vessel preferably comprises moving, optionally articulated partitions that act as breakwaters against basin storms.

The invention also relates to a process for rescuing vessels in distress with a rescue vessel that can be ballasted and that has a basin of the above-mentioned type; the process comprises a first phase of movement of the rescue vessel toward the site of the vessel in distress; a second phase, executed close to the vessel in distress, of ballasting the rescue vessel such that at least one upper edge of the basin is found below the level of the keel of the vessel in distress; a third phase of introducing the vessel in distress into the basin; and a fourth phase of putting the upper edge of the basin above sea level.

The fourth phase of putting the upper edge at a level that is above sea level is preferably carried out by closing a door of the basin.

The fourth phase of putting the upper edge of the basin above sea level preferably comprises the movement of the vessel in vertical direction by ballasting, with evacuation of the water outside of the vessel.

Before the first phase or at the beginning of the latter, the process preferably comprises the ballasting of the vessel with its smallest practical draft.

The process also comprises, after the fourth phase, the movement of the rescue vessel to a protected location that promotes the execution on the vessel in distress of an operation that is selected from among repair and unloading of the cargo.

The ballasting of the vessel with its smaller draft preferably comprises the evacuation of the basin.

The invention also relates to the application of a rescue vessel of the above-mentioned type to the moving of marine farming modules at sea.

It also relates to the application of a rescue vessel of the above-mentioned type in the formation of a dry dock.

It also relates to the application of a rescue vessel of the above-mentioned type in the formation of an artificial port for small boats in the case of a storm.

Other characteristics and advantages of the invention will better emerge from the following description, done in reference to the accompanying drawing, in which.

Figure 1:
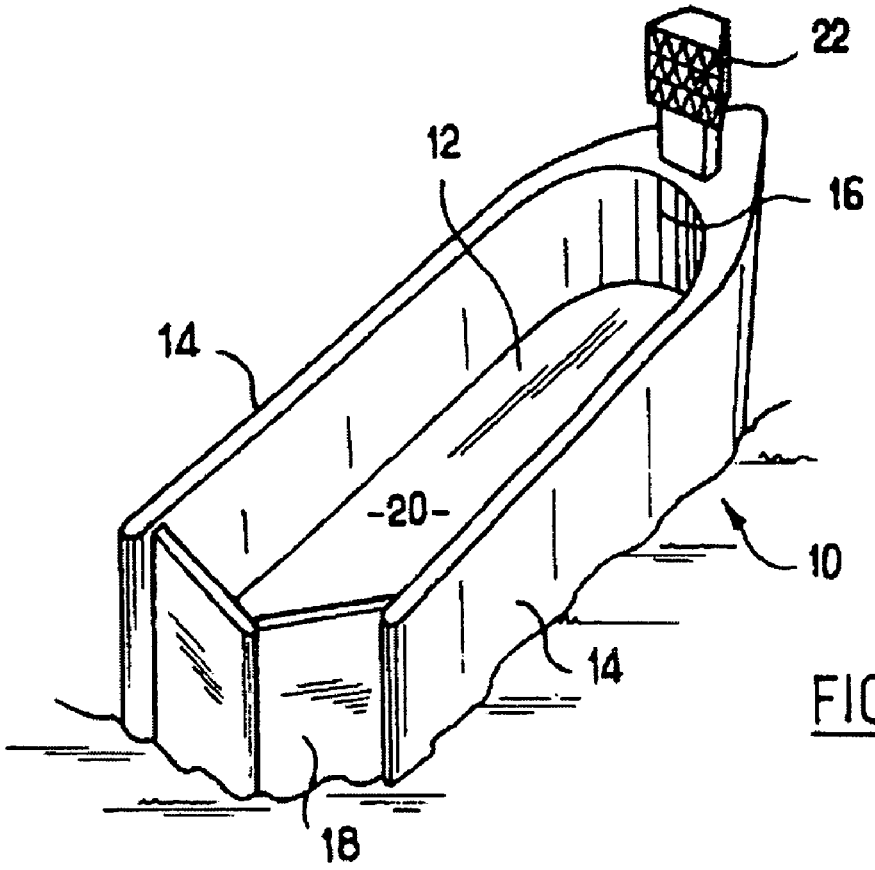
FIG. 1 is a very schematic perspective view of a rescue vessel in a first embodiment of the invention.

FIG. 1 shows a rescue vessel 10 that has a basin 12 of very large dimensions, delimited between two lateral hulls 14, a front part 16, rear doors 18 and a bottom 20. The vessel also has a bridge 22, shown in the front, but that can occupy any other location on the vessel.

Although these elements were not shown, the vessel advantageously comprises propulsion engines, maneuvering engines that allow in particular transverse movements to the front and to the rear, stabilizers, breakwaters, etc. It also comprises at least one winch that makes it possible to tow a vessel to make it enter into basin 12 when rear doors 18 are open. This winch can be mounted on a gantry, either fixed, preferably above the door, or mobile along the basin. The vessel can also comprise two gantries, one of which is mobile.

The rescue vessel also preferably comprises devices for guiding and holding a vessel in distress inside the basin, such as thrusters, for example hydraulic thrusters, that are incorporated in the basin.

The use of the rescue vessel according to the embodiment of FIG. 1 is now described.

When the alarm is given, rescue vessel 10, which is stationed in the center of its surveillance zone, with its empty basin 12, can immediately be directed toward a vessel in distress at a high speed, because it has a low draft since its basin is empty and its hulls that can be ballasted can already be empty. Otherwise, they can be emptied from the beginning of the movement so that the draft is as small as possible in a manner compatible with the sea conditions and the current navigation possibilities.

When it approaches a vessel in distress, rescue vessel 10 can begin to flood the ballast tanks and to sink into the sea. At the same time, basin 12 starts to become filled, and doors 18 are opened wide. Thanks to its maneuverability, vessel 10, after having thrown a cable that is attached to the front or to the rear of the vessel in distress, or even without a cable when the vessel in distress is again maneuvering, is oriented such that its rear part that is opened wide is rotated toward the vessel in distress. The latter is then introduced into basin 12, either by its own means, or with the propulsion means of vessel 10 that can come close to the vessel in distress, either with the assistance of a winch or with the assistance of any combination of these various means. When the vessel has entered basin 12, doors 18 are closed. Compressed air, preferably previously held in compressed air tanks, expels water from the ballast tanks so that rescue vessel 10 rises relative to sea level. From this time, any risk of pollution is eliminated. Actually, the vessel in distress is protected in the basin of the rescue vessel; even if it is in the state of sinking or breaking up, the possible pollution is limited to basin 12. Based on the particular case of the vessel in distress, the basin can be emptied or not, partly or completely. At this time, rescue vessel 10 can move to facilitate operations such as the repair of the vessel or the unloading of its cargo, for example by drawing closer to the side.

As the preceding description indicates, rescue vessel 10 can reach the location of the vessel in distress in a very short time, at most several hours, and upon putting the vessel in distress in the basin, any risk of pollution is eliminated. In addition, it makes it possible to preserve the vessel in distress that has not been lost and that most often can be recovered.

In an embodiment, the rescue vessel that is being considered has a basin of about 95 m in width and 400 m in length, whose rear doors have a reach of at least about 48 m and a height of 78 m.

Maneuvering such doors by a single vertical articulation that is placed on one edge poses difficult technological problems. It is then useful to produce such doors in triangulated form. More specifically, each flap of the double rear door can be in the form of two parts that are articulated together around a vertical axis that is designed to work with the vertical axis of the other flap in the closed position of the door. The ends of the two articulated parts that are distant from the vertical axis are themselves attached to the corresponding vertical side of the rear hull. These attachments can be either simply articulated (for example at the rear end of the side of the vessel) or articulated on a slide that can move horizontally along the side of the rear hull. The two attachments can also comprise slides.

In the case of the above-mentioned rescue vessel, the dimensions of the basin are such that it can establish the known phenomenon under the name of "basin storm." It is then preferable to eliminate such storms that can constitute a serious impediment for handling the rescued vessel. Mobile partitions or breakwaters are then advantageously incorporated between the two lateral hulls.

The above-mentioned triangulation system can also be applied to other parts of the rescue vessel, for example to basin storm breakwaters, to thrusters for holding the rescued vessel, to handling gantry supports placed between the sides, etc.

In a variant embodiment of FIG. 1, the basin comprises a door such as 18 at each end. It is then essential that the two lateral hulls be connected by several fixed gantries. The various necessary elements are housed in the two hulls.

In another variant embodiment of FIG. 1, at least one door, for example a sliding door that has a height on the order of 40 m and a width on the order of 25 to 30 m, can be formed at the front of the basin in a lateral hull or at the front of the vessel. Such doors are intended to allow the exit of one or more tugs that could have been used for the introduction of the rescued vessel into the basin. As this exit is carried out when the basin is full, these doors are placed toward the top of the lateral hulls. Two doors are preferably formed at the front of each lateral hull so that the tugs can exit from the basin by the windward side.

Figure 2:
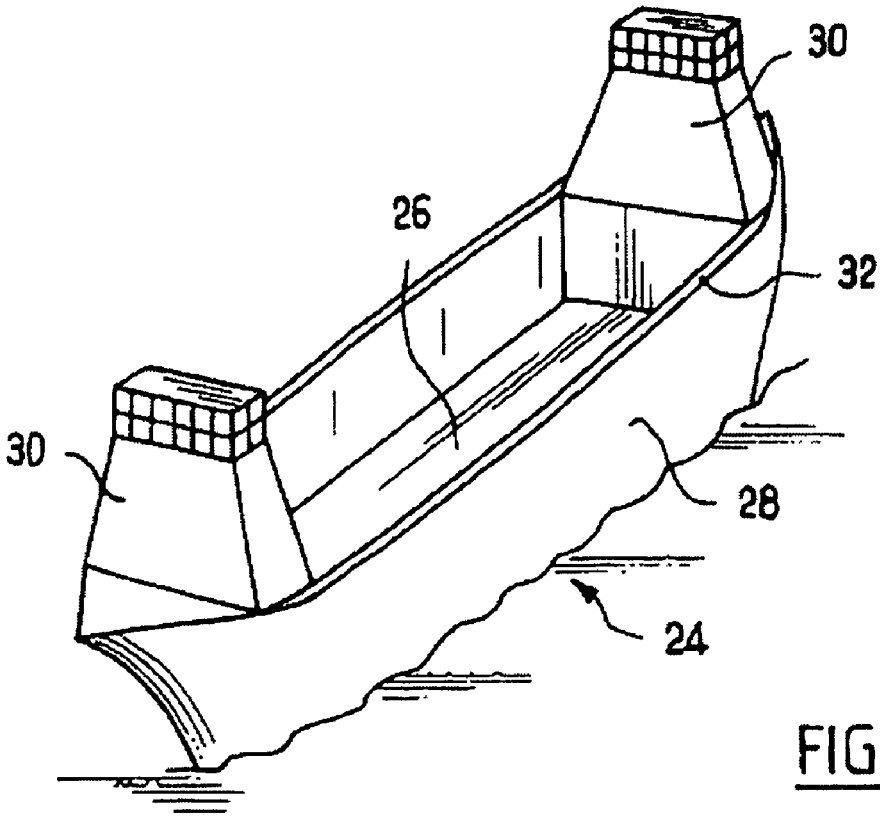
FIG. 2 is a very schematic perspective view of a rescue vessel in a second embodiment of the invention.

FIG. 2 shows another rescue vessel embodiment. More specifically, rescue vessel 24 of FIG. 2 comprises a hull 28 that delimits a basin 26, shown in parallelepipedic shape, although this shape, as in the first embodiment, is not essential. In particular, the bottom is not necessarily flat, and the basin may have, for example, a shape that narrows toward the bottom, in section via a transversal vertical plane. Such an arrangement can be adopted, for example, for the acceleration of the ballasting.

At each end, the vessel comprises a structure 30 that preferably carries, at its upper part, a bridge. Structure 30 is not a simple superstructure. In fact, it is higher than FIG. 2 indicates such that the vessel can be almost completely immersed, whereby only the upper parts of structures 30 project above the sea. Of course, even in this position, the vessel has buoyancy reserves that make it unsinkable.

During the use of rescue vessel 24, the latter, which evacuated its basin 26, can be brought quickly to the location of the vessel in distress. When it approaches the vessel in distress, water is introduced into the ballast tanks such that the rescue vessel sinks in the water. When it is beside the vessel in distress, upper edges 32 of the basin should be under the water at a depth that is at least equal to the draft of the vessel in distress increased by a safety margin that depends on the condition of the sea. Vessel 24, which has transversal propulsion means at its two ends, can be placed laterally under the vessel in distress, then compressed air is quickly introduced into its ballast tanks to expel the water. As soon as upper edges 32 of the basin are raised above the level of the lower part of the keel of the vessel in distress, the latter is trapped in the basin. The raising of rescue vessel 24 is carried out until the upper edges of the basin are above sea level, at a desired height, taking into account the circumstances and in particular the weather. At this time, as in the first embodiment, the vessel in distress can no longer create pollution.

Relative to the first embodiment, rescue vessel 24 of the second embodiment offers the advantage of not requiring the maneuvering of any moving part subject to the condition of the sea in any rescue operation.

Of course, the rescue vessels according to the invention have very large dimensions. So that they can avoid most of the pollution incidents or oil slicks, their basin 12 or 26 should have a length of at least 150 m, preferably at least 250 m, and very advantageously at least 300 m. The width of the basin should be at least 30 m and preferably at least 50 m and even more. In the example that is indicated above, the rescue vessel that is considered has a basin of about 95 m of width and 400 m of length, and the height of the hull reaches 78 m. The rescue vessel then has considerable dimensions and mass, such that it is virtually unsusceptible to storms and can be used regardless of the condition of the sea. In addition, by its dimensions and mass, it makes it possible, by suitable positioning, to create a local calm that facilitates the entry into the basin of the vessel in distress, taking into account the swell and the current possibly present.

For the extremely improbable case where the rescue vessel would be subjected to a so-called "rogue" wave when it is responsible for a vessel in distress, it may be advantageous to use redundant devices. Thus, the bridge, with its navigation systems, safety systems, etc., and the engine room can each be duplicated. Thus, a machine room can be placed in each of the lateral hulls. Of course, the parts that can undergo the most significant stresses can be suitably reinforced for this purpose.

In the first embodiment, it is desirable that the ballasting of the vessel made possible a draft alteration on the order of 15 m and preferably of at least 20 or 25 m. In the case of vessel 24 of the second embodiment, it is desirable that the draft variations can reach 30 m and even more.

In reference to FIGS. 3 to 6, two variants of the first embodiment are now described.

Figure 3:
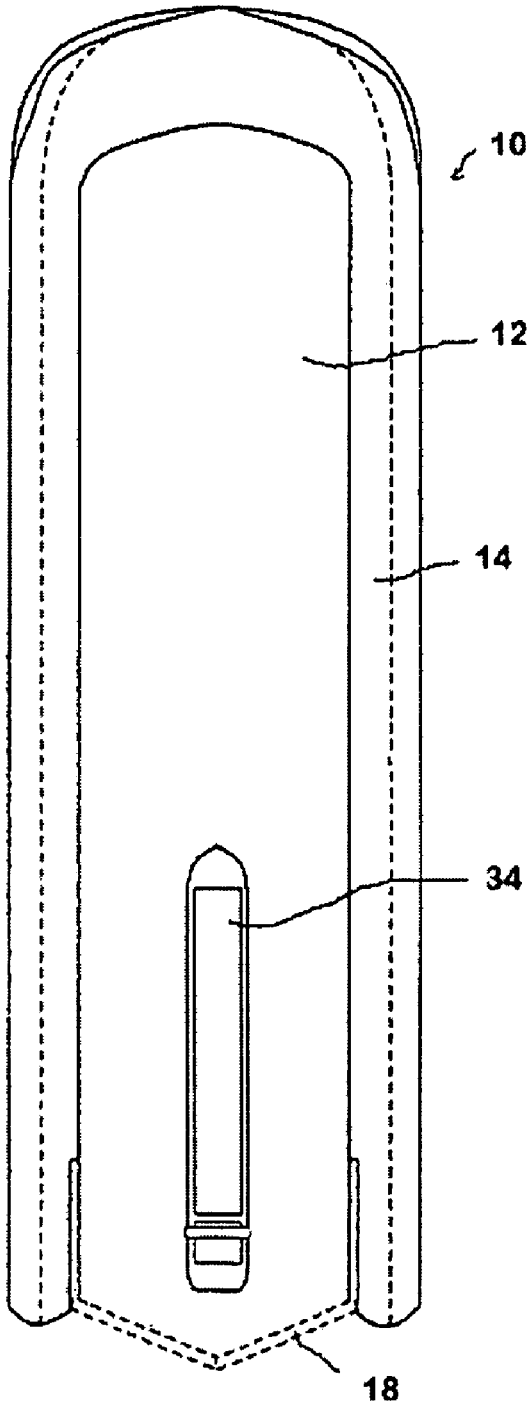
FIG. 3 is a bird's eye view of a variant of the first embodiment.
Figure 4:
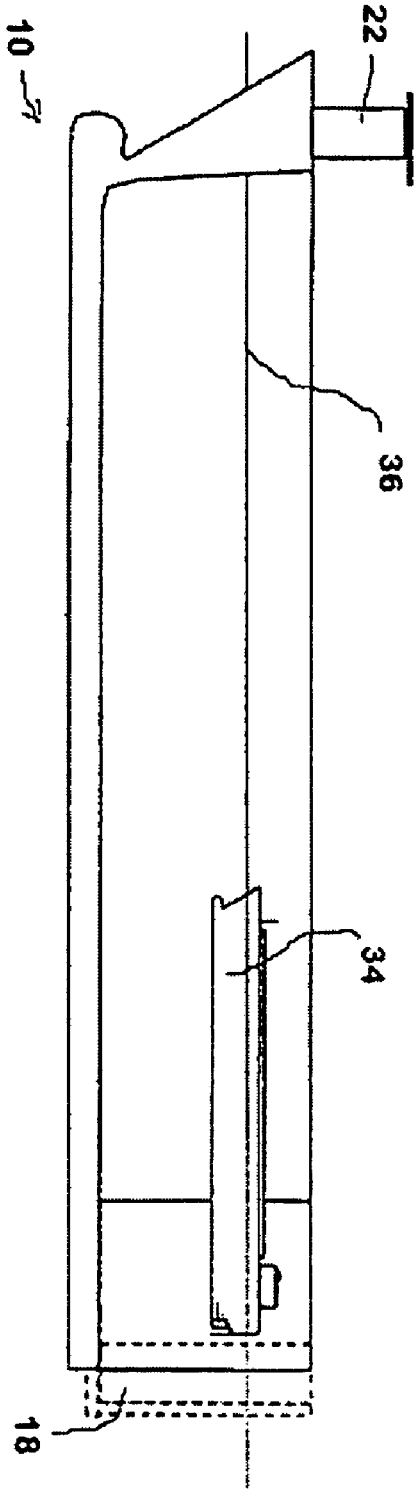
FIG. 4 is a schematic sectional drawing of the variant of FIG. 3.

FIGS. 3 and 4 show, in a bird's eye view and in a longitudinal section, a rescue vessel 10 that has a basin 12 of about 95 m of width and 400 m of length, and the height of the hull reaches 78 m. A vessel in distress 34 that is 150 m in length is shown in basin 12. It is realized in these figures that the introduction of the vessel in distress into the basin, either by its own means, or by means of propulsion and maneuvering of the rescue vessel, either with the assistance of a tug or by any combination of these means, is easy, taking into account the very great space available for maneuvering.

Figure 5:
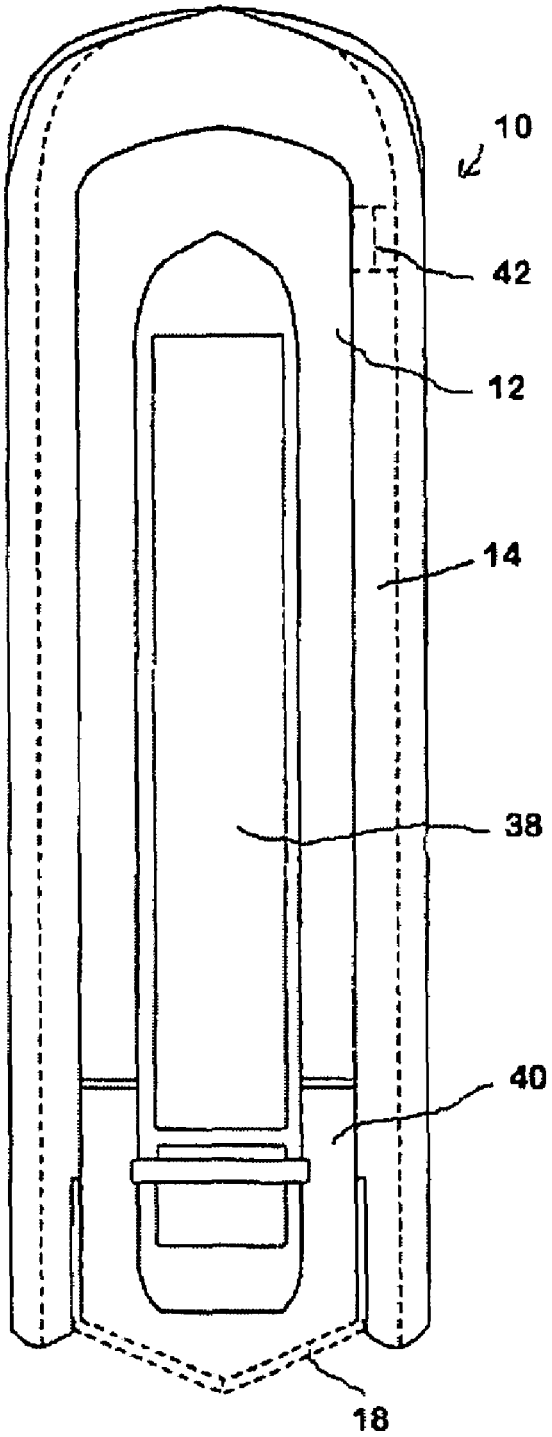
FIG. 5 is a bird's eye view of another variant of the first embodiment.
Figure 6:
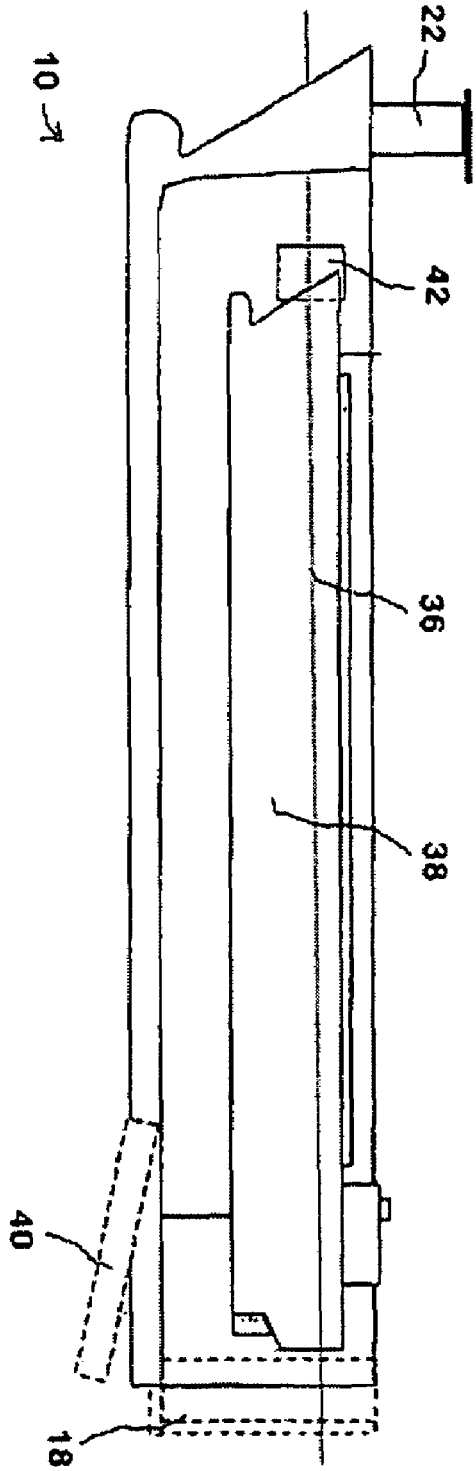
FIG. 6 is a schematic sectional drawing of the variant of FIG. 5.

FIGS. 5 and 6 show, in a bird's eye view and in longitudinal section, a rescue vessel 10 that also has a basin 12 of about 95 m of width and 400 m of length, and whose hull height reaches 78 mm. A vessel in distress 38 that is 360 m in length is shown in basin 12. In this variant, the rear part of the bottom of the basin consists of a detachable panel 40 that constitutes a floor that can itself be ballasted. This floor, having, for example, a length of 80 m, can be reduced, as indicated in FIG. 6, to facilitate the entrance of a vessel in distress of very large dimensions.

In another variant, the rear part of the bottom comprises a floor and a panel, as indicated in 40, which can be ballasted and can slide by pivoting to close the rear, instead of doors 18 that are then superfluous. The maneuvering of this panel is then carried out essentially by ballasting.

Of course, the rescue vessel can comprise other equipment that is suitable for its missions, for example, a landing platform for helicopters, means for anchoring vessels in distress, means for fighting fire of a vessel in distress before, during or after its entry into the basin of the rescue vessel, means for treatment, in particular by filtration, of water of the basin, means for storing waste, in particular recovered by filtering or on the vessel in distress, and/or means for at least patching up a damaged vessel.

The rescue vessel according to the invention exhibits the following considerable advantages.

First of all, it eliminates the problem of pollution as quickly as possible, while preventing the vessel in distress from sinking and most often allowing its recovery. The cargo can also be recovered and optionally pumped to a ground installation or to other vessels.

These possibilities for recovering the vessel and the cargo, on the one hand, and the elimination of all of the effects of pollution, on the other hand, represent considerable economic advantages.

Another considerable economic advantage is that it is no longer necessary to forbid the navigation of single-hull vessels in good operating condition, since the problems that they could pose can be easily resolved. It is no longer necessary to establish ports of refuge for vessels in distress, whereby this solution, mentioned simply in a theoretical manner, offers such inconveniences that it is not probable that it will ever actually be considered.

In addition, such vessels can be used not only to avoid such major pollution incidents but also for other applications. In particular, the construction at sea of marine farms whose modules have large dimensions (on the order of one hundred meters and more) and that should sometimes be moved has begun. Such a rescue vessel is perfectly suited for this purpose.

The rescue vessel has other applications for transport of bulky structures, such as vessels and parts of vessels, and drilling or production platforms and parts of such platforms.

The rescue vessel also makes possible the formation of a dry dock, for example, in the case of moving a fleet.

Finally, in the case of a strong storm, such a rescue vessel can be used as an artificial port to protect small boats.

If the rescue vessel is conventionally used only for the rescue of vessels in distress, there are long periods during which it is on standby, having enough room on the sides, taking into account its large dimensions and its draft. It can then be used as a support for energy-generating devices of the renewable type. For example, it can carry wind power engines or photovoltaic devices. The energy that is obtained can be either stored in electrical form or in chemical form, for example for being used by the vessel for its missions, or transmitted to shore by a connecting device at sea.

Of course, various modifications can be provided by one skilled in the art to vessels, processes and applications that were just described only by way of non-limiting example without exceeding the scope of the invention.

The invention claimed is:

1. Rescue vessel for vessels, comprising:

an elongated basin (12, 26) at least 250 m in length and 45 m in width which can be closed to limit to said basin pollution by a vessel in distress protected in the basin, a ballast device that makes it possible to alter the vessel's draft by at least 20 m, a hull that comprises two lateral hulls that surround said basin (12, 26) and that delimits at least one upper edge of said basin (12, 26), the ballast device operating between at least two positions in one of which positions the basin (12, 26) is evacuated and at least the upper edge is found above sea level, and in the other of which positions the basin (12, 26) is full with an end of the basin found below a level of a keel of a vessel in distress, and maneuvering means configured to exert a thrust in a direction that is transverse to at least a longitudinal axis of the vessel, wherein, the stern comprises a sealed door (18) with a height of at least 40 m and configured to close and seal the rear of basin on an edge that is found below the level of the keel of the vessel in distress, the stern of the hull being sealed thereby protecting the vessel in distress in the basin and limiting possible pollution from the vessel in distress to the basin.

2. Rescue vessel according to claim 1, wherein two port and starboard longitudinal sides (28) of the hull both have a height that is lower by at least 20 m than that of two other delimited sides at the front and at the rear of the vessel, and their upper edge (32) is virtually rectilinear on the largest part of its length and is provided with a reinforcement.

3. Process for rescuing vessel in distress with the assistance of a rescue vessel (10, 24) that can be ballasted and that has a basin (12, 26) according to claim 1, wherein it comprises:

a first phase of movement of a rescue vessel (10, 24) toward the location of the vessel in distress, a second phase, executed close to the vessel in distress, of ballasting the rescue vessel (10, 24) such that at least one upper edge of a basin (12, 26) is found below the level of the keel of the vessel in distress, and a third phase for introducing the vessel in distress into basin (12, 26) by maneuvering to exert a thrust in a direction that is transverse to at least the longitudinal axis of the vessel, to orient the vessel such that its rear part that is opened wide is rotated toward the vessel in distress, and protecting the vessel in distress in the basin and closing the door to seal the rear of the basin limiting possible pollution from the vessel in distress to the basin, and a fourth phase of putting the upper edge of basin (12, 26) above sea level.

4. Application of a rescue vessel (10, 24) according to claim 1 to the transport of bulky structures that are selected from among the vessels and parts of vessels, the drilling or production platforms, and the parts of such platforms, and the marine farming modules at sea, including a phase, executed close to said bulky structures, of ballasting said rescue vessel (10, 24) such that at least one upper edge of basin (12, 26) is found below the level of the lowest part of said bulky structure.

5. Rescue vessel according to claim 1, wherein at least one rear door has a height on the order of 78 m.

* * * * *